US011612777B2

(12) United States Patent
Clarke

(10) Patent No.: US 11,612,777 B2
(45) Date of Patent: Mar. 28, 2023

(54) EXERCISE DEVICE

(71) Applicant: Karl Chevon Clarke, Brooklyn, NY (US)

(72) Inventor: Karl Chevon Clarke, Brooklyn, NY (US)

( * ) Notice: Subject to any disclaimer, the term of this patent is extended or adjusted under 35 U.S.C. 154(b) by 0 days.

(21) Appl. No.: 17/329,793

(22) Filed: May 25, 2021

(65) Prior Publication Data

US 2021/0394004 A1 Dec. 23, 2021

Related U.S. Application Data

(60) Provisional application No. 63/040,954, filed on Jun. 18, 2020.

(51) Int. Cl.

| | |
|---|---|
| ***A63B 21/00*** | (2006.01) |
| ***A63B 23/035*** | (2006.01) |
| ***A63B 23/12*** | (2006.01) |

(52) U.S. Cl.

CPC .. *A63B 21/00192* (2013.01); *A63B 21/00069* (2013.01); *A63B 21/4035* (2015.10); *A63B 21/4045* (2015.10); *A63B 23/03541* (2013.01); *A63B 23/12* (2013.01)

(58) Field of Classification Search

CPC ..... A63B 21/00192; A63B 21/00069; A63B 21/4035; A63B 21/4045; A63B 23/03541; A63B 23/12; A63B 21/0004

See application file for complete search history.

(56) References Cited

U.S. PATENT DOCUMENTS

| | | | | |
|---|---|---|---|---|
| 767,008 | A * | 8/1904 | Pelletier et al. | A63B 21/0004 482/112 |
| 3,834,696 | A * | 9/1974 | Spector | A63B 21/4045 482/112 |
| 3,955,655 | A * | 5/1976 | Pornin | A63B 21/4045 188/313 |
| 5,529,559 | A * | 6/1996 | Punzalan | A63B 21/4045 482/111 |
| 5,735,780 | A * | 4/1998 | Fazio | A63B 23/03525 482/112 |
| 6,468,190 | B1 * | 10/2002 | Fazio | A63B 23/03525 482/114 |
| 7,569,003 | B1 * | 8/2009 | Huffman | A63B 21/4045 482/111 |
| 9,259,633 | B2 | 2/2016 | Meyers | |
| 9,377,733 | B2 | 6/2016 | Nishizawa et al. | |
| 2003/0017920 | A1 * | 1/2003 | Fazio | A63B 21/0087 482/112 |
| 2018/0200574 | A1 * | 7/2018 | Connolly | A63B 21/028 |

FOREIGN PATENT DOCUMENTS

| | | | |
|---|---|---|---|
| WO | WO9813108 | A1 | 4/1998 |
| WO | WO9910049 | A1 | 3/1999 |

* cited by examiner

*Primary Examiner* — Andrew S Lo
(74) *Attorney, Agent, or Firm* — Patent Law Clinic, NYLS

(57) ABSTRACT

An exercise device having a first handle, a second handle, and a cylindrical chamber. The cylindrical chamber is oriented in that the first handle is attached at one end of the cylindrical chamber and the second handle is attached at the other end of the cylindrical chamber. The cylindrical chamber contains a system that facilitates magnetic, tension resistance. Bisecting the surface of the cylindrical chamber, is a knob connected to a fixed component that adjusts the magnetic, tension resistance within the cylindrical chamber.

7 Claims, 3 Drawing Sheets

EXERCISE DEVICE

PRIORITY CLAIM/INCORPORATION BY REFERENCE

This application claims priority to the U.S. Provisional Application Ser. No. 63/040,954 filed on Jun. 18, 2020 and entitled "Paladin Edge", the entirety of which is incorporated herein by reference.

BACKGROUND INFORMATION

Exercising from home has become commonplace in our post-pandemic world. As many adjust to exercising at home, our approach to strength training has had to adapt to our new fitness environments. Exercise equipment used primarily for strength training in gyms is bulky and incompatible for home use. Additionally, the current exercise equipment on the market that has been adapted for home use does not provide adequate resistance for strength training. There is a clear need for exercise equipment that is portable, compact, and most importantly, provides adequate resistance for strength training.

SUMMARY

Exemplary embodiments describe an exercise device having a first handle and a second handle wherein each of said first and second handles are constructed and arranged to facilitate adjustable resistance within a cylindrical chamber. The cylindrical chamber is comprised of exemplary embodiments that facilitate tension resistance for activities including, but not limited to, hand stretch, chest stretch, upper back stretch, hand compression, chest compression, upper back compression, and the like.

DETAILED DESCRIPTION OF THE INVENTION

Figure 1:
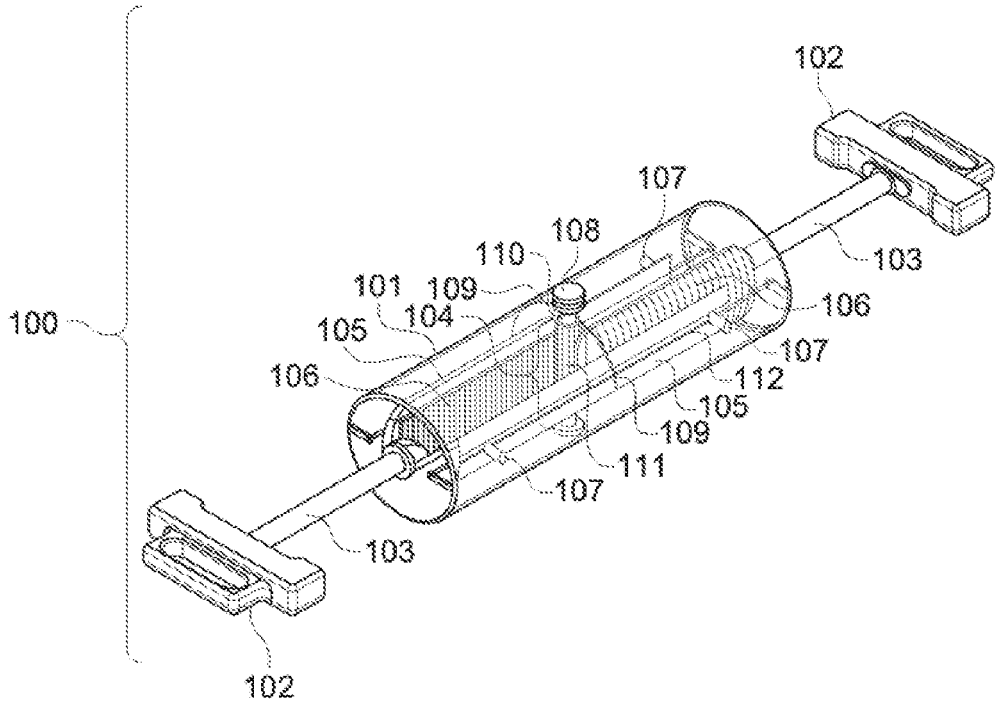
FIG. 1 shows a first view of an exemplary adjustable tension resistance exercise device according to various exemplary embodiments.

The exemplary embodiments may be further understood with reference to the following description and the appended drawings, wherein like elements are referred to with the same reference numerals. The exemplary embodiments provide an adjustable tension resistance exercise device that primarily works the upper body and is suitable to be used as home strength training exercise equipment.

FIG. 1 shows a first view of an exemplary adjustable tension resistance exercise device 100 according to various exemplary embodiments. The exemplary adjustable tension resistance exercise device 100 comprises a cylindrical chamber 101, two handles 102, and two rods 103, each of which are connected to a respective handle 102. In the example of FIG. 1, the handles 102 are shown in an extended position. As will be described in greater detail below, the handles 102 may be moved to a non-extended position by pushing the handles 102 inward. When this occurs, the rods 103 move into the interior of the cylindrical chamber 101 along a longitudinal axis of the cylindrical chamber 101.

In the example of FIG. 1, the cylindrical chamber 101 is shown as being transparent so as to show the various exemplary components that may be included in the interior of the cylindrical chamber 101. The cylindrical chamber 101 includes a fixed component 104, comprising of a central shaft 110 and a rack spur gear 111, two magnetic brackets 105, two rack spurs 106, four springs 107, a knob 108 controlling the resistance, a magnetic bracket brace 112, and two chords 109. It should be understood that FIG. 1 shows the adjustable tension resistance exercise device 101 in an operable position, e.g., as it would appear while in use. Thus, the handles 102, the rods 103, the magnetic brackets 105, and the rack spurs 106 are shown in an extended position.

The fixed component 104 allows for inward and outward movements of the handles 102 and also allows the user to change the desired resistance by using the knob 108. The fixed component 104 may be rotated clockwise or counterclockwise. The fixed component 104, can only be rotated a maximum of 180 degrees whenever the handles 102 are pushed inwards (non-extended), or pulled outwards (extended). The inward motion is clockwise, and the outward motion is counterclockwise. The rack spur gear 111 of the fixed component 104 acts in conjunction with the rack spurs 106 to transform rotational motion to linear motion. Specifically, there is a first rack spur 106 that engages the fixed component 104 at a first orthogonal side of the fixed component 104 and a second rack spur 106 that engages the fixed component 104 at a second orthogonal side of the fixed component 104, where the first and second orthogonal sides are 180 degrees apart. Each rack spur 106 is attached to a rod 103 which in turn is attached to each handle 102. Each magnetic bracket 105 resides next to each rack spur 106 within the inner wall of the cylindrical chamber 101, and is attached to springs 107, chords 109, and magnetic bracket brace 112.

The cylindrical chamber 101 also includes the knob 108 that extends from an outer wall of the cylindrical chamber 101 such that a user has access to the knob 108. The user may change the resistance of the adjustable tension resistance exercise device 100 by turning the knob 108, which moves independently from the fixed component 104. If the knob 108 is rotated, the fixed component 104 will not rotate. When the fixed component 104 rotates, the knob 108 does not move.

The fixed component 104 allows for the change in the resistance. The magnetic brackets 105 are configured to move with respect to the knob 108, chords 109, and magnetic bracket brace 112. Each magnetic bracket 105 is coupled to two springs 107, a chord 109 (which bisect the magnetic brackets 105 and are attached at the base of the magnetic brackets 105 on its posterior side), and a magnetic bracket brace 112. A portion of the knob 108 contains a small hole which is connected to the chords 109 and the magnetic bracket 105, such that, when the user turns the knob 108, the chords 109 move the magnetic bracket brace 112, which simultaneously moves the magnetic bracket 105 inwards and outwards from the rack spur 106 and magnetic brackets 105, thus increasing or decreasing the resistance. When the knob 108 is turned, the two chords 109 pull the magnetic bracket 105 towards or away from the rack spur 106. As a result, the magnetic bracket 105 which is attached to the springs 107 and the magnetic bracket brace 112, pulls away from the rack spur 106. The closer the magnetic bracket 105 is to the rack spur 106, the higher the resistance. The further away the magnetic bracket 105 is to the rack spur 106, the lower the resistance.

Figure 2:
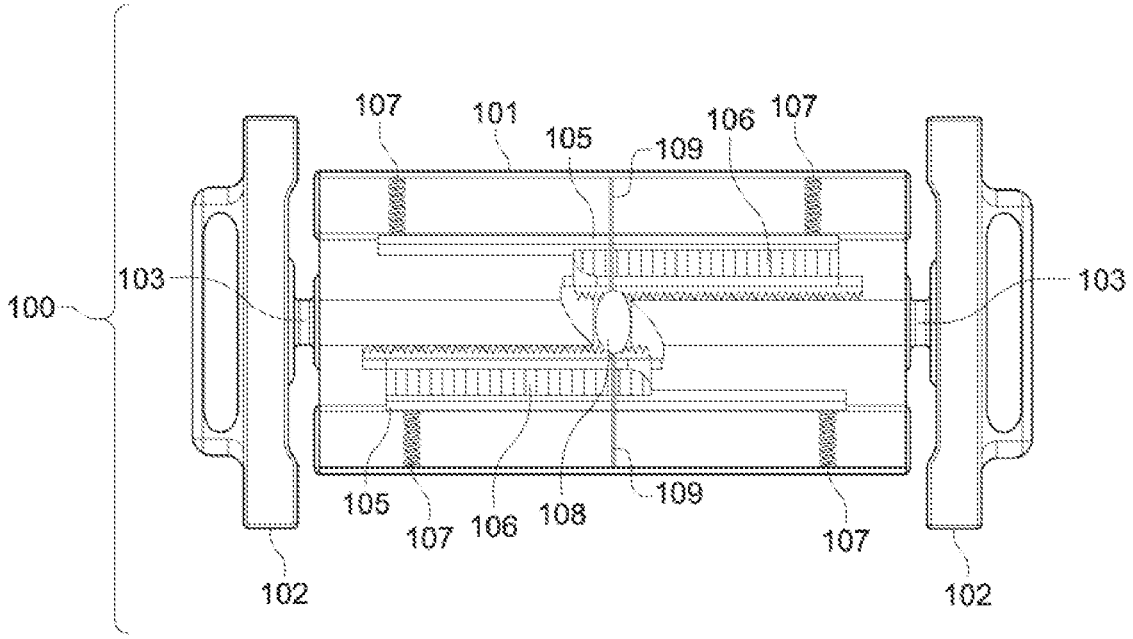
FIG. 2 shows a second view of an exemplary adjustable tension resistance exercise device according to various exemplary embodiments.

FIG. 2 shows a second view of an exemplary adjustable tension resistance exercise device 100 according to various exemplary embodiments. It should be understood that FIG. 2 shows the adjustable tension resistance exercise device 100 in an unused position, e.g., as it would appear while not in use. Thus, the designation of the two handles 102, two magnetic brackets 105, and two rack spurs 106 are shown in an un-extended position. Those skilled in the art will understand that the adjustable tension resistance exercise device 100 may also be moved to an extended position by pulling the handles 102 outward.

Figure 3:
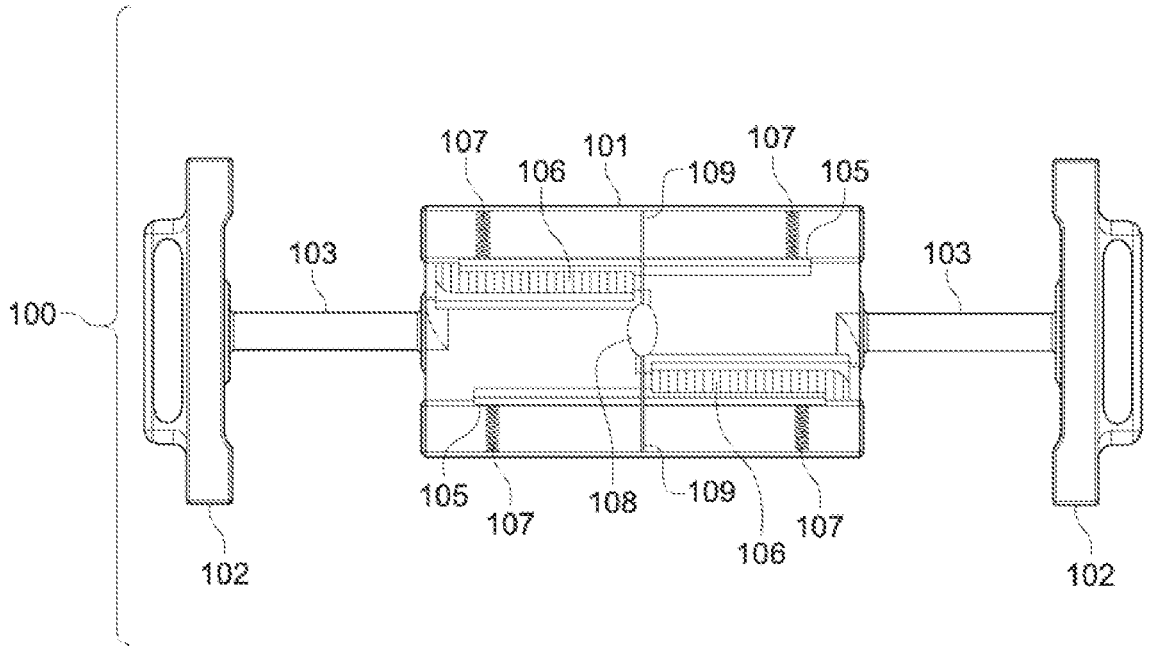
FIG. 3 shows a third view of an exemplary adjustable tension resistance exercise device according to various exemplary embodiments.

FIG. 3 shows a third view of an exemplary adjustable tension resistance exercise device 100 according to various exemplary embodiments. In addition to changing the resistance, the fixed component 104 also allows for the inward and outward movement of the handles 102. When both handles 102 are pulled outwards, they are moving in opposite direction of the fixed component 104. As the handles 102 are pulled outward, the fixed component 104 interacts with the two rack spurs 106, allowing the half turn around the fixed component 104 and the outward movement of the handles 102.

It should be understood that FIG. 3 shows the adjustable tension resistance exercise device 100 in an operable position, e.g., as it would appear while in use. Thus, the designation of the two handles 102, two magnetic brackets 105, and two rack spurs 106 are shown in an extended position. Those skilled in the art will understand that the adjustable tension resistance exercise device 100 may also be moved to an extended position by pushing the handles 102 inward.

It will be apparent to those skilled in the art that various modifications may be made in the present disclosure, without departing from the spirit or the scope of the disclosure. Thus, it is intended that the present disclosure cover modifications and variations of this disclosure provided they come within the scope of the appended claims and their equivalent.

What is claimed:

1. An exercise device, comprising:

a first handle;

a second handle; and a cylindrical chamber wherein the first handle extends from a first end of the cylindrical chamber and the second handle extends from a second end of the cylindrical chamber, and wherein the cylindrical chamber comprises, a fixed component;

a first chord;

a second chord;

a first magnetic bracket coupled to the first chord and a second magnetic bracket coupled to the second chord configured to move towards or away from the fixed component; and a knob configured to change a resistance exerted on the first and second handles based on the two magnetic brackets, when the knob is turned, the two chords pull the two magnetic brackets towards or away from the fixed component.

2. The exercise device of claim 1, wherein the device includes a first rod extending from the first end of the cylindrical chamber, and a second rod extending from the second end of the cylindrical chamber, the first handle coupled to the first rod and the second handle coupled to the second rod.

3. The exercise device of claim 2, wherein the first rod is coupled to a first rack spur, and the second rod is coupled to a second rack spur.

4. The exercise device of claim 1, wherein the cylindrical chamber comprises a first end and a second end, and the cylindrical chamber forms a cylindrical internal cavity.

5. The exercise device of claim 4, wherein the fixed component comprises a central shaft coupled with a spur gear around the central shaft.

6. The exercise device of claim 5, wherein the two magnetic brackets configured to move toward or away from the fixed component comprise the two magnetic brackets coupled with a first spring and a second spring on each end of a posterior side of the magnetic brackets and coupled with the two chords bisecting the magnetic brackets and attached at a base of the magnetic brackets on the posterior side.

7. The exercise device of claim 6, wherein the knob contains a small hole which is connected to the two chords such that when the knob is turned, the chords move the magnetic brackets inwards or outwards from the first rack spur and the second rack spur, thus increasing or decreasing resistance.

* * * * *